US008207466B2

(12) United States Patent
Singh et al.

(10) Patent No.: US 8,207,466 B2
(45) Date of Patent: Jun. 26, 2012

(54) MULTI-POSITION PUSHBUTTON WITH INTEGRAL LED AND ACTUATOR

(75) Inventors: Neeraj Singh, McDonaugh, GA (US); Tinghao Wang, Eden Prairie, MN (US); Li-Chih Ree, Alpharetta, GA (US); Xinhua Chen, Atlanta, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 848 days.

(21) Appl. No.: 12/234,930

(22) Filed: Sep. 22, 2008

(65) Prior Publication Data

US 2009/0078548 A1 Mar. 26, 2009

Related U.S. Application Data

(60) Provisional application No. 60/973,883, filed on Sep. 20, 2007, provisional application No. 60/973,873, filed on Sep. 20, 2007, provisional application No. 60/973,868, filed on Sep. 20, 2007.

(51) Int. Cl.
*H01H 3/02* (2006.01)

(52) U.S. Cl. ..... 200/538; 200/537; 200/329

(58) Field of Classification Search ..... 200/538–541, 200/520, 523, 529–531, 314, 329–345
See application file for complete search history.

(56) References Cited

U.S. PATENT DOCUMENTS

| | | | | |
|---|---|---|---|---|
| 4,383,144 | A | 5/1983 | Kleeb | |
| 5,055,643 | A * | 10/1991 | Pardini et al. | 200/318.2 |
| 6,268,577 | B1 * | 7/2001 | Marquardt et al. | 200/330 |
| 2003/0022765 | A1 * | 1/2003 | Wu | 482/92 |
| 2007/0051602 | A1 | 3/2007 | Tan | |

* cited by examiner

*Primary Examiner* — Amy Cohen Johnson
*Assistant Examiner* — Marina Fishman

(57) ABSTRACT

The present invention relates generally to pushbutton actuators. More particularly, the invention encompasses a pushbutton 2 position twist release switch with integral LED and actuator. The invention also includes a pushbutton 3 position momentary switch with an integral LED and actuator. Another embodiment of the invention relates to a pushbutton 3 position maintained switch with an integral LED and actuator. The invention also includes various embodiments of the inventive pushbutton actuator of this invention. The inventive pushbutton also comprises a pushbutton knob that has ridges for the transmission and scattering of light for the LED in the module.

30 Claims, 20 Drawing Sheets

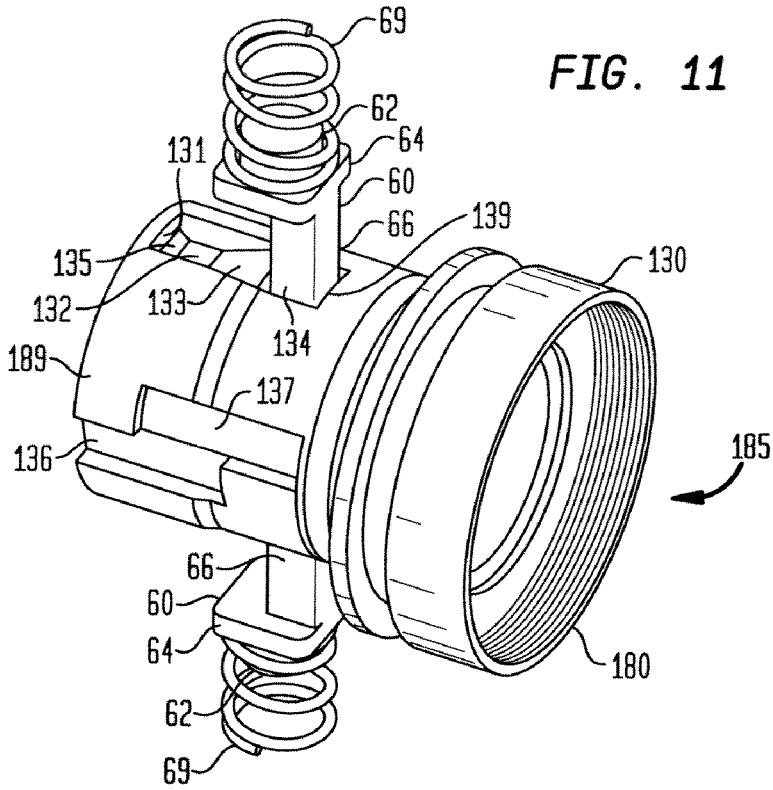
FIG. 11
FIG. 12
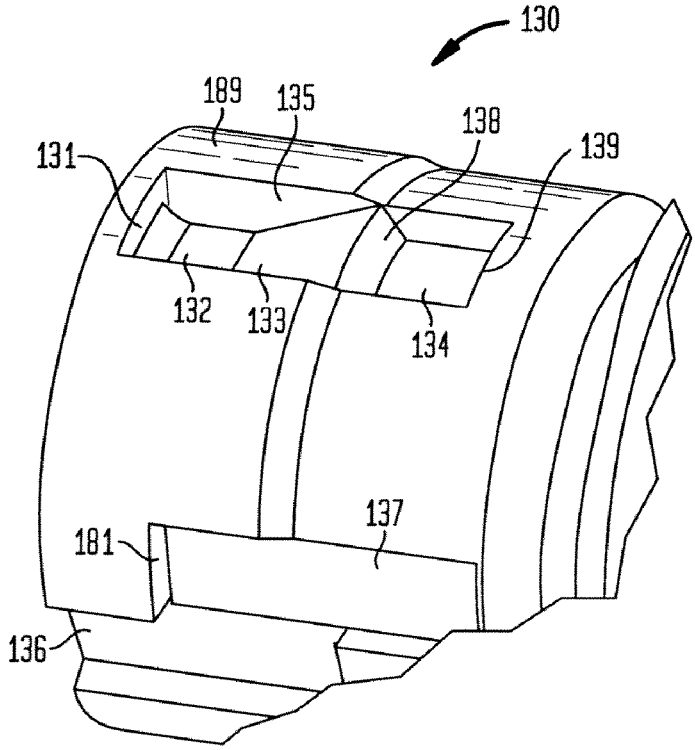

FIG. 27
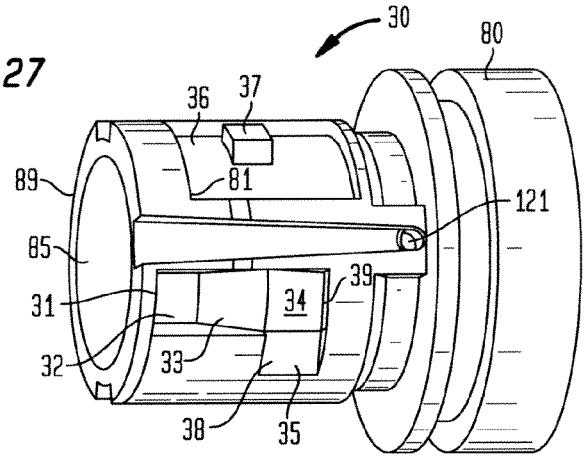
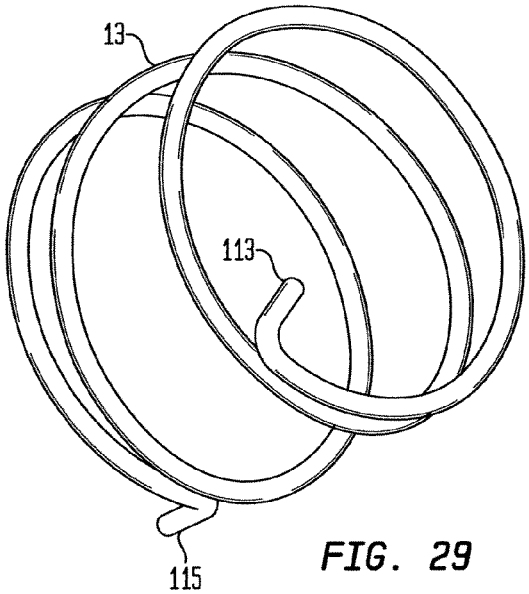
FIG. 28
FIG. 29
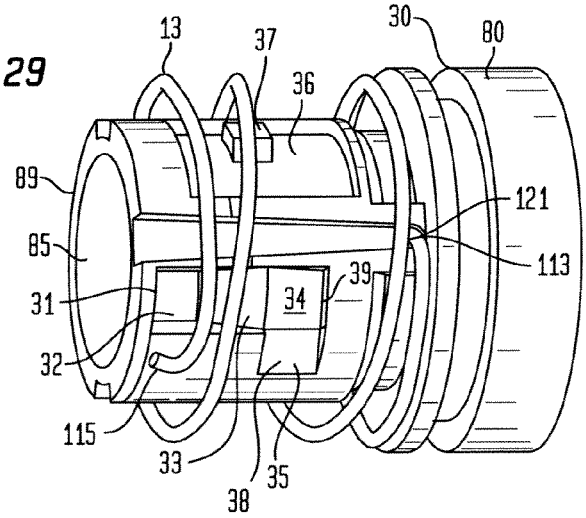

MULTI-POSITION PUSHBUTTON WITH INTEGRAL LED AND ACTUATOR

CROSS-REFERENCE TO RELATED APPLICATION

The instant patent application is related to U.S. Provisional Patent Application Ser. No. 60/973,883, filed on Sep. 20, 2007, titled "Pushbutton 2 Position Twist Release With Integral LED Actuator," U.S. Provisional Patent Application Ser. No. 60/973,873, filed on Sep. 20, 2007, titled "Pushbutton 3 Position Momentary With Integral LED Actuator," and U.S. Provisional Patent Application Ser. No. 60/973,868, filed on Sep. 20, 2007, titled "Pushbutton 3 Position Maintained With Integral LED Actuator," the entire disclosures of each are incorporated herein by reference.

FIELD OF THE INVENTION

The present invention relates generally to pushbutton actuators. More particularly, the invention encompasses a pushbutton 2 position twist release switch with integral LED and actuator. The invention also includes a pushbutton 3 position momentary switch with an integral LED and actuator. Another embodiment of the invention relates to a pushbutton 3 position maintained switch with an integral LED and actuator. The invention also includes various embodiments of the inventive pushbutton actuator of this invention. The inventive pushbutton also comprises a pushbutton knob that has ridges for the transmission and scattering of light for the LED in the module.

BACKGROUND INFORMATION

Pushbutton switches are well known in the art. A typical pushbutton switch has a plunger guide housing in which a plunger can be manually moved in an axial direction against the force of a return spring. The pushbutton switch can be secured my means of a securing device, such as, screws, and are known to contain at least one moving contact. Several control elements can also be provided with these switches, and these control elements can be arranged, for example, in series in the direction of the motion of the plunger, so that the moving contacts can be brought from one switching position into another switching position. The control elements can also be designed so that a return spring can act on the actuator which presses the actuator against one end position, which could be, for example, a "rest position," and then by manually pressing the plunger again the plunger moves the actuator from the "rest position," against the force of the return spring into another end position, which could be, for example, a "working position."

U.S. Pat. No. 4,383,144 (Markus Kleeb), the entire disclosure of which is incorporated herein by reference, discloses a pushbutton switch that has a plunger guide housing in which a plunger is displaceably guided and on which control elements are detachably mounted on different sides of the plunger axis. Each control element is pushed onto a guide extending parallel to the direction of motion of the plunger and is held by a locking bolt which is rotatably mounted in the plunger guide housing. In each control element housing is mounted a spring-loaded actuator for displacement transverse to the direction of motion of the plunger, so that it can be moved by pressing the plunger from a rest position into a working position. This design has the effect that the forces produced primarily by the return springs of the actuators and transmitted over the actuators in their working position, do not exert a great force on the plunger extending parallel to the direction of motion of the plunger.

US Patent Publication No. 20070051602 (Jun-Ming Tan), the entire disclosure of which is incorporated herein by reference, discloses a sealed pushbutton switch (1) includes an insulative housing (2), a number of fixed contacts (7), an actuator (3) moveably retained in the insulative housing, a moveable contact (6) fastened to the actuator and including a pair of elastic beams (62) each provided with a contact portion (621) contactable to corresponding fixed contacts to establish a reliable electrical connection between the fixed contacts, and a spring (5) mounted below the actuator. When the actuator is pushed, the moveable contact has an agile movement to break the electrical connection between the moveable contact and the fixed contacts.

Thus, a need exists for an improved pushbutton actuator switch.

This invention overcomes the problems of the prior art and provides an inventive pushbutton actuator switch.

PURPOSES AND SUMMARY OF THE INVENTION

The invention is a novel pushbutton actuator switch.

Therefore, one purpose of this invention is to provide a novel pushbutton switch having an integral LED and actuator.

Another purpose of this invention is to provide a pushbutton switch with a twist release and having an integral LED and actuator.

Yet another purpose of this invention is to provide a pushbutton switch having a two position twist release with an integral LED and actuator.

Still yet another purpose of this invention is to provide a pushbutton switch having a two position maintained switch with an integral LED and actuator.

Another purpose of this invention is to provide a pushbutton switch having a two position momentary switch with an integral LED and actuator.

Yet another purpose of this invention is to provide a pushbutton switch having a three position momentary switch with an integral LED and actuator.

Still yet another purpose of this invention is to provide a pushbutton switch having a three position maintained switch with an integral LED and actuator.

Yet another purpose of this invention is to provide a pushbutton switch having a light with an integral LED and actuator.

Therefore, in one aspect this invention comprises a pushbutton actuator, comprising:

(a) a push-pull body, wherein said push-pull body has a first portion and a second portion, wherein said first portion comprises of a substantially hollow cylindrical body, and said second portion comprises a substantially flat portion;
(b) at least one anti-rotational tab, wherein a portion of said tab is secured to said first portion and wherein a portion of said tab is secured to said second portion;
(c) a detent bearing, wherein said flat portion having an area to accommodate said detent bearing;
(d) a knob, wherein said first portion having an area to accommodate said knob;
(e) an actuator, wherein at least a portion of said actuator is enveloped within a hollow portion of said push-pull body,
(f) a module, wherein a portion of said module passes through said detent bearing, said first and said second portion of said push-pull body, and is in proximate contact with said actuator, and thereby forming said pushbutton actuator.

In another aspect this invention comprises a pushbutton actuator, comprising:

(a) a push-pull body, wherein said push-pull body has a first portion and a second portion, wherein said first portion comprises of a substantially hollow cylindrical body, and said second portion comprises a substantially flat portion;

(b) at least one anti-rotational tab, wherein a portion of said tab is secured to said first portion and wherein a portion of said tab is secured to said second portion;

(c) a detent bearing, wherein said detent bearing has at least one vertically oriented opening to accommodate a vertical movement of a pusher, and at least one longitudinally oriented opening to accommodate a longitudinally oriented spring, and wherein said push-pull body has an area to accommodate said detent bearing;

(d) a knob, wherein said first portion having an area to accommodate said knob;

(e) an actuator, wherein at least a portion of said actuator is enveloped within a hollow portion of said push-pull body, (f) a module, wherein a portion of said module passes through said detent bearing, said first and said second portion of said push-pull body, and is in proximate contact with said actuator, and thereby forming said pushbutton actuator.

In yet another aspect this invention comprises a pushbutton actuator, comprising:

(a) a push-pull body, wherein said push-pull body has a first portion and a second portion, wherein said first portion comprises of a substantially hollow cylindrical body, and said second portion comprises a substantially flat portion;

(b) at least one anti-rotational tab, wherein a portion of said tab is secured to said first portion and wherein a portion of said tab is secured to said second portion;

(c) a detent bearing, wherein said flat portion having an area to accommodate said detent bearing;

(d) a knob, wherein said first portion having an area to accommodate said knob;

(e) an actuator, wherein at least a portion of said actuator is enveloped within a hollow portion of said push-pull body, (f) a module, wherein a portion of said module passes through said actuator, said detent bearing, said first and said second portion of said push-pull body, and is in proximate contact with said knob, and wherein said detent bearing is in proximate contact with said module, and thereby forms said pushbutton actuator.

BRIEF DESCRIPTION OF THE DRAWINGS

The features of the invention that are novel and the elements characteristic of the invention are set forth with particularity in the appended claims. The drawings are for illustration purposes only and are not drawn to scale. Furthermore, like numbers represent like features in the drawings. The invention itself, both as to organization and method of operation, may best be understood by reference to the detailed description which follows taken in conjunction with the accompanying drawings in which:

FIG. 11 is an enlarged perspective view of an exemplary actuator along with a pusher and a spring according to the embodiment illustrated in FIG. 10.

FIG. 12 is an enlarged perspective detailed view of an exemplary actuator according to the embodiment illustrated in FIG. 10.

FIG. 27 is an enlarged side perspective view of an exemplary actuator according to the embodiment illustrated in FIG. 1.

FIG. 28 is an enlarged perspective view of an exemplary spring according to the embodiment illustrated in FIG. 1.

FIG. 29 is an enlarged side perspective view of an exemplary actuator and spring according to the embodiment illustrated in FIG. 1.

DETAILED DESCRIPTION

Figure 1:
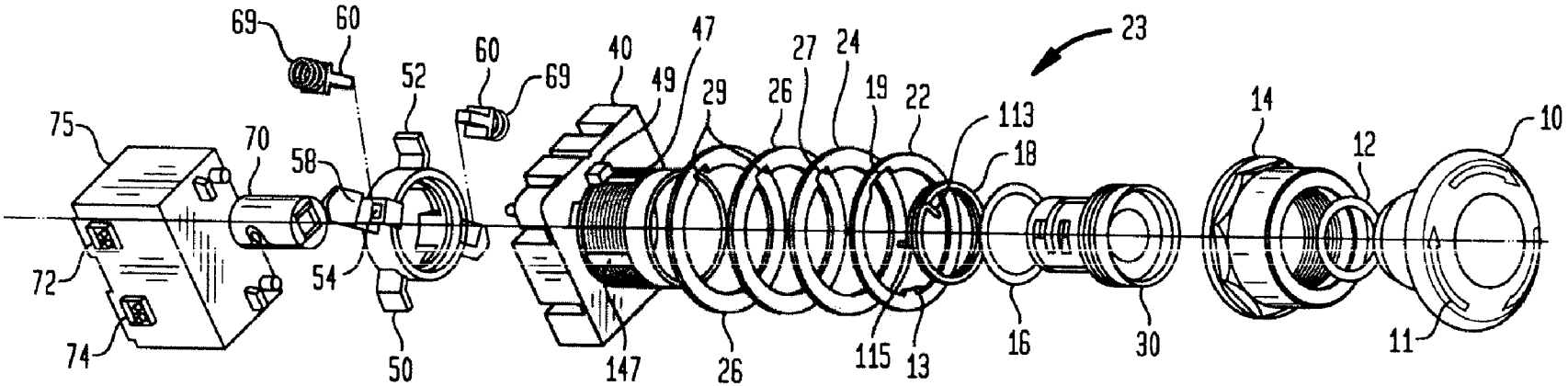
FIG. 1 is an exploded view of an exemplary pushbutton switch having a two position twist release switch with an integral LED Module and actuator which is used to illustrate a preferred embodiment of the present invention.

FIG. 1 is an exploded view of an exemplary pushbutton switch 23, having a two position twist release switch with an integral LED and Actuator which is used to illustrate a preferred embodiment of the present invention. The pushbutton switch 23, as illustrated in detail in FIGS. 1 through 9, has a knob or button 10, with or without markings 11. The knob or button 10, is preferably a mushroom head type button 10. The button 10, is preferably a twist-and-turn type of a button. At least one gasket or O-ring 12, separates the button 10, from Actuator 14. The pushbutton switch 23, has an actuator 30, which is guided by the push-pull body 40. A plurality of O-ring or gasket 16 is mounted on the actuator 30 to provide a seal between the actuator 30, and the body 40. The spring 18, between the actuator 30, and the body 40, as shown in FIGS. 1, 28 and 29, provides torsional and axial forces. Washer 22, washer 24, gasket 26 are provided between the locknut 14, and the push-pull body 40. The pushbutton switch 23, also has a detent bearing 50, that is between the push-pull body 40, and a module 75. The module 75, has at least one LED 70, and at least one first power connection 72, and at least one second power connection 74. The push-pull body 40, has at least one first flat guide surface 47, and at least one second flat guide surface 147, and wherein at least one of the first flat guide surface 47, terminates at an anti-rotational notch or tab 49. The washer 22, preferably has at least one guiding notch or bent tab 19, and at least one guiding tab 13, that can guide along one of the peripheral surfaces of the push-pull body 40, such that, bent tab 19, guides along the first flat guide surface 47, and the guiding tab 13, guides along the second flat guide surface 147, and secures the gaskets 26, and the washer 24, to the push-pull body 40. It should be appreciated that the second flat guide surface 147, is preferably a substantially flat smooth area or surface and preferably there are no threads. Additionally, in order to prevent the rotation of the washer 24, and the gasket 26, it is preferred that the washer 24, has at least one guiding notch 27, and that the gasket 26, has at least one guiding notch 29. It should be appreciated that the bent tab 19, faces the push-pull body 40, and during assembly passes through the guiding notch 27, and the guiding notch 29, before coming to rest adjacent or near anti-rotational tab 49.

Figure 2:
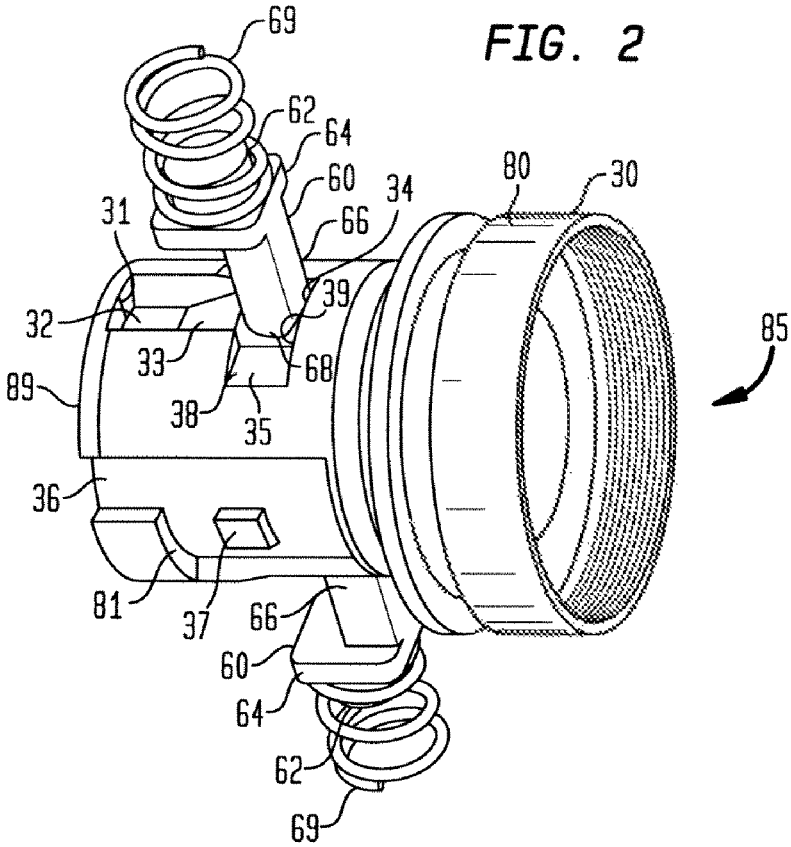
FIG. 2 is an enlarged perspective view of an exemplary actuator along with a pusher and a spring according to the embodiment illustrated in FIG. 1.

FIG. 2 is an enlarged perspective view of an exemplary actuator 30, along with at least one pusher 60, and at least one pusher spring 69, according to the embodiment illustrated in FIG. 1. The pusher 60, has round base or end 62, which accommodates one end of the pusher spring 69, and a center base 64, which abuts one end of the spring 69. The pusher 60, has a male portion 66, which extends from the center base 64, and ends in a round or contoured end 68.

As illustrated in FIG. 2, the actuator 30, cap end 80, and a substantially cylindrical portion 89. The substantially cylindrical portion 89, has a substantially inverted L-shaped channel 35, and a substantially P-shaped channel 36. The inverted L-shaped channel 35, is defined by a back wall or stop 31, and a front wall or stop 39, and a first or back channel stop 32, a mid-ramp 33, a second or front channel stop 34, and a side-ramp 35. The P-shaped channel 36, has a center island 37, and a back stop 81, so as to force a component to move in a P-shaped movement. However, for some applications one could have a Q-shaped channel 36, as more clearly seen in FIG. 31.

As shown in FIG. 2, the contoured end 68, of the pusher 60, can move in a somewhat P-direction, by starting at the first or back channel stop 32, moving up the mid-ramp 33, into the second or front channel stop 34, moving up the side-ramp 38, over to the cylindrical portion 89, and then back into first or back channel stop 32, as the P-shaped channel 36, only allows movement in a front and back direction or a square direction, and thus the pusher 60, once in the inverted L-shaped channel 35, would either stop a back stop 32, or front stop 39, or the component carrying the pusher 60, will be stopped by the back stop 81.

Figure 3:
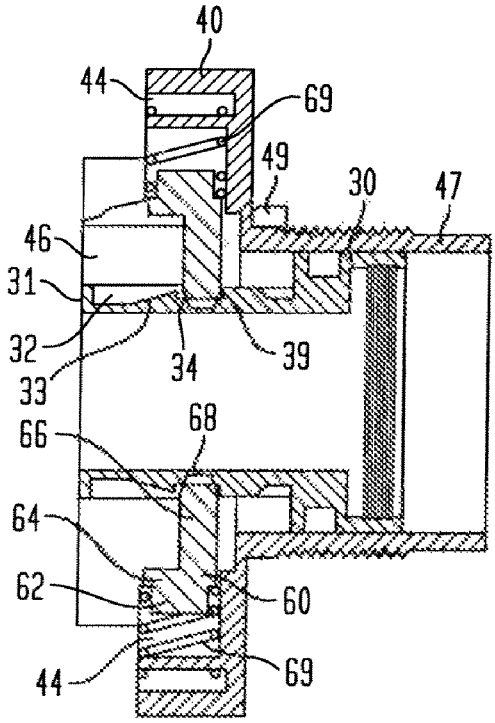
FIG. 3 is an enlarged sectional side view of an exemplary actuator along with a pusher and a spring as assembled inside a push-pull body according to the embodiment illustrated in FIG. 1.

FIG. 3 is an enlarged sectional side view of an exemplary actuator 30, along with at least one pusher 60, and at least one spring 69, as assembled inside a push-pull body 40, according to the embodiment illustrated in FIG. 1. In FIG. 3, one can also clearly see that one of the flat guide surface 47, terminates at the anti-rotational notch or tab 49, of the push-pull body 40. The sectional side view of FIG. 3, also shows the contoured end 68, of the pusher 60, resting inside the front stop 39, of the inverted L-shaped channel 35, while the pusher 60, and the spring 69, are contained inside a spring channel 44, in the push-pull body 40. During assembly the gasket 26, having notch 29, is slid along the flat surface 47, and positioned over the tab 49. Next the washer 24, having notch 27, is slid along the flat surface 47, and positioned over the tab 49. This is followed by placing the washer 22, having the notch 29, which is then slid along the flat surface 47, and positioned over the tab 49. Because each of the notches 29, 27 and 19, rest and are nested on the tab 49, the tab 49, acts as an anti-rotational device and prevents the rotation of the components, such as, for example washer 22, washer 24, and the gasket 26.

Figure 4:
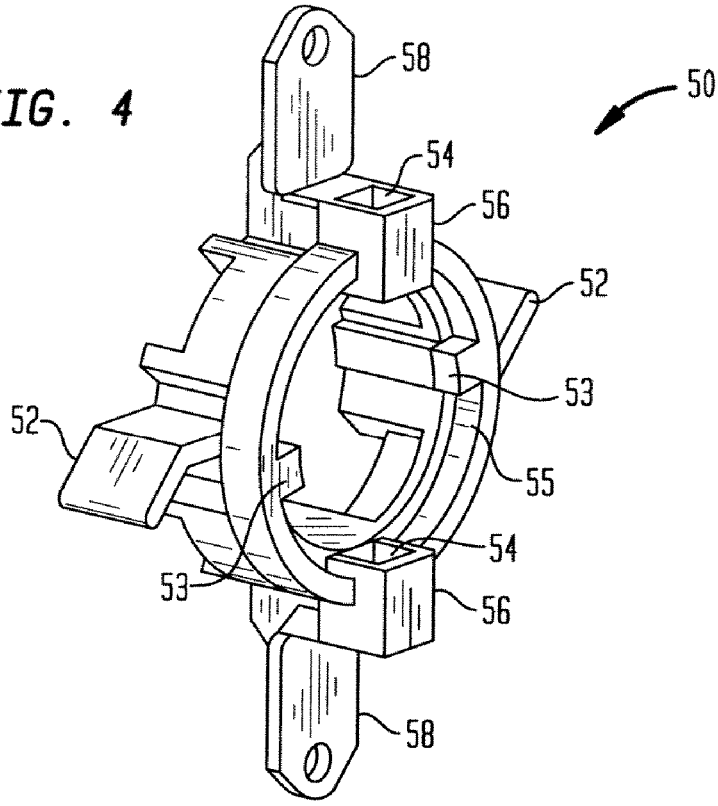
FIG. 4 is an enlarged perspective view of an exemplary detent bearing from a front side according to the embodiment illustrated in FIG. 1.

FIG. 4 is an enlarged perspective view of an exemplary detent bearing 50, from a front side according to the embodiment illustrated in FIG. 1. The detent bearing 50, has a substantially central hole or opening 55, having at least one track or channel 53. The detent bearing 50, preferably has at least one pusher support 56, have an opening or hole 54, and a brace 58, to guide the center base 66, along with the pusher spring 69. The detent bearing 50, also has at least one extension or wing 52, that guides and secures the detent bearing 50, inside a corresponding channel or opening 42, in the push-pull body 40. The central opening 55, preferably has at least one track or protrusion or channel 53, that guides and secures the P-shaped channel 36, in the actuator 30. For some applications the push-pull body 40, has a hole or opening 116, to securely accommodate the end 115, of the spring 13, as clearly seen in FIG. 28.

Figure 5:
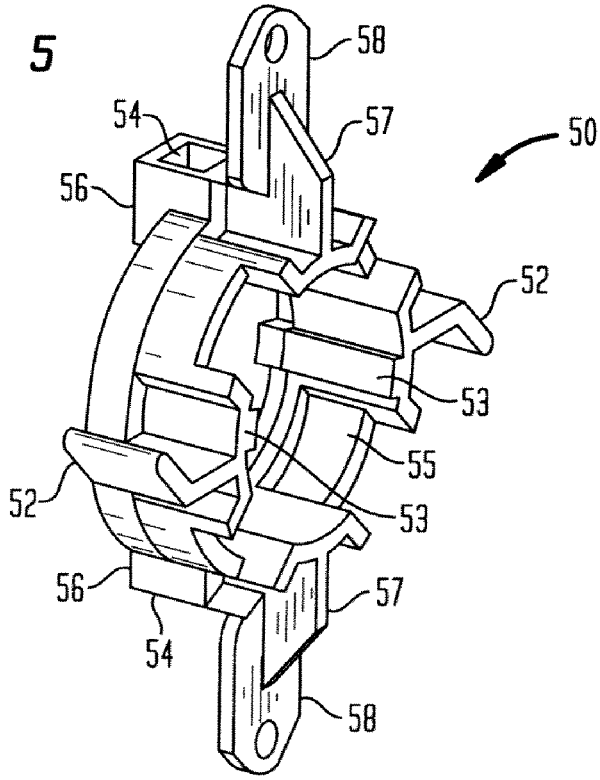
FIG. 5 is an enlarged perspective view of an exemplary detent bearing from a back side according to the embodiment illustrated in FIG. 1.

FIG. 5 is an enlarged perspective view of an exemplary detent bearing 50, from a back side according to the embodiment illustrated in FIG. 1. For some applications one could have a side brace 57, to support the brace 58.

Figure 6:
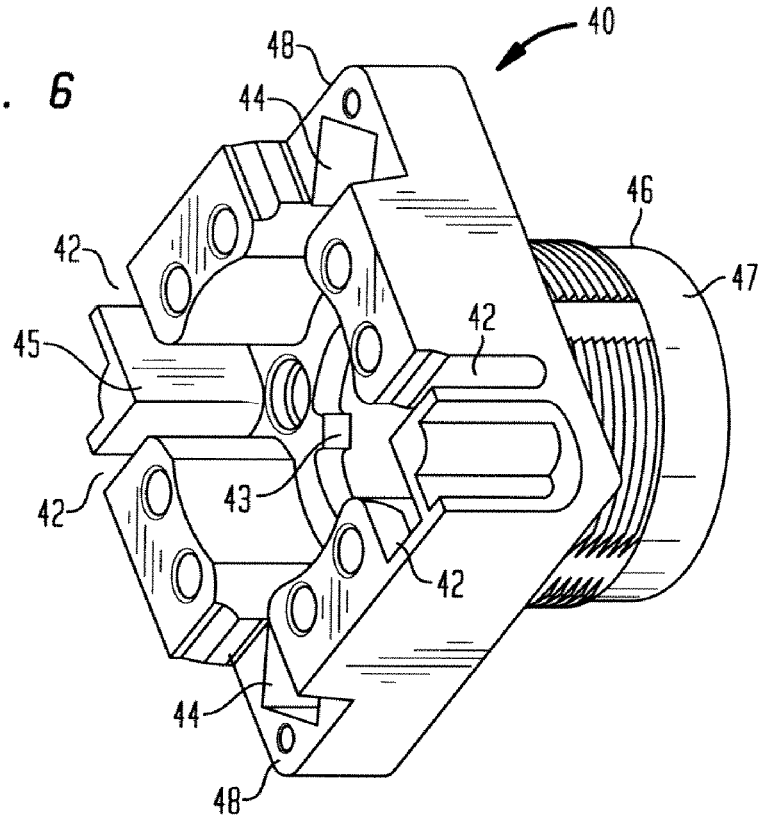
FIG. 6 is an enlarged perspective view of an exemplary push-pull body according to the embodiment illustrated in FIG. 1.

FIG. 6 is an enlarged perspective view of an exemplary push-pull body 40, according to the embodiment illustrated in FIG. 1 The push-pull body 40, preferably has at least one channel or opening 42, to guide and secure the corresponding extension or wing 52, of the detent bearing 50. The push-pull body 40, also has at least one opening or channel 44, to guide and secure a portion of the pusher 60, and the pusher spring 69, such that, the brace 58, of the detent bearing 50, rests against a face 48, in the push-pull body 40. The central opening 45, preferably has at least one tab or protrusion 43, that guides and secures the P-shaped channel 36, in the actuator 30.

Figure 7:
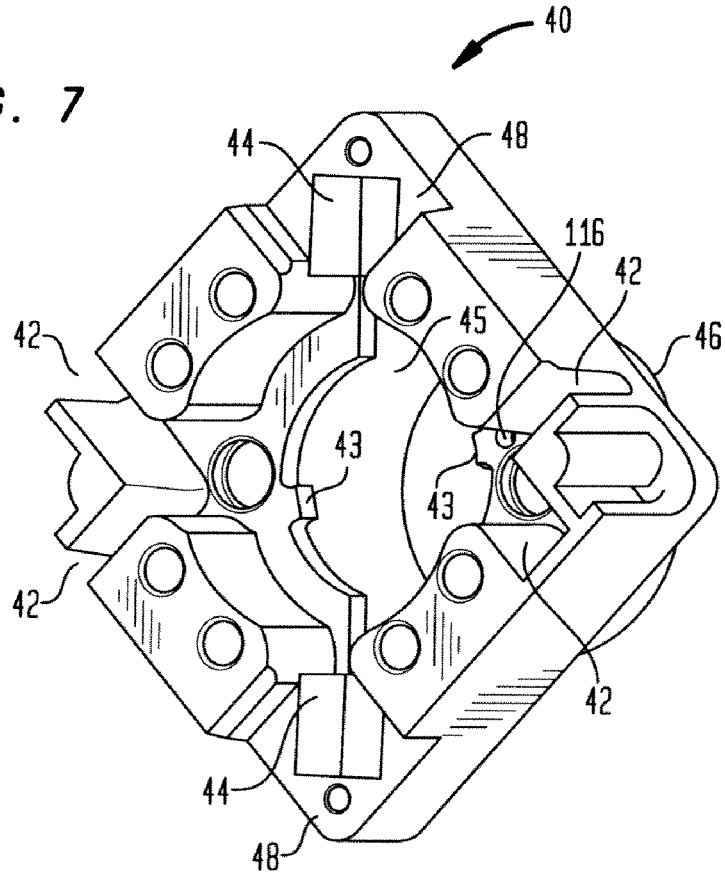
FIG. 7 is an enlarged perspective view of an exemplary push-pull body according to the embodiment illustrated in FIG. 1.

FIG. 7 is an enlarged perspective view of an exemplary push-pull body 40, according to the embodiment illustrated in FIG. 1.

Figure 8:
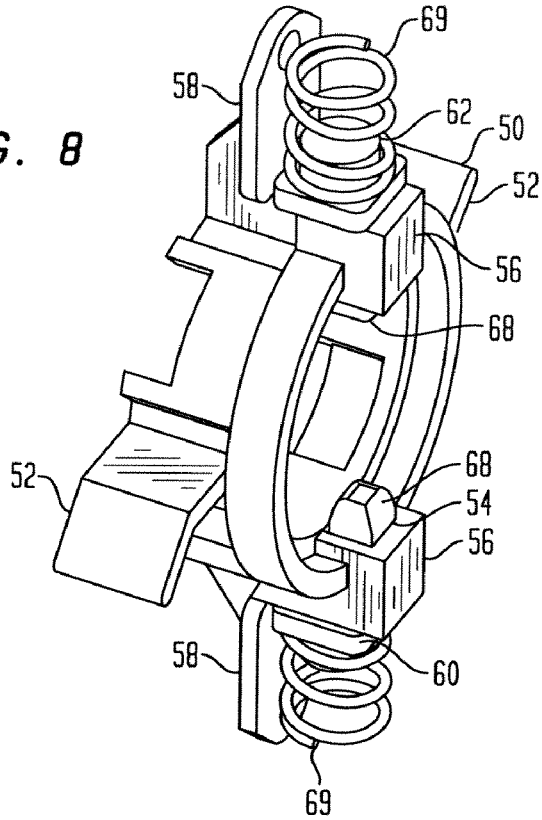
FIG. 8 is an enlarged perspective view of an exemplary detent bearing along with a pusher and a spring according to the embodiment illustrated in FIG. 1.

FIG. 8 is an enlarged perspective view of an exemplary detent bearing 50, along with a pusher 60, and a spring 69, according to the embodiment illustrated in FIG. 1.

Figure 9:
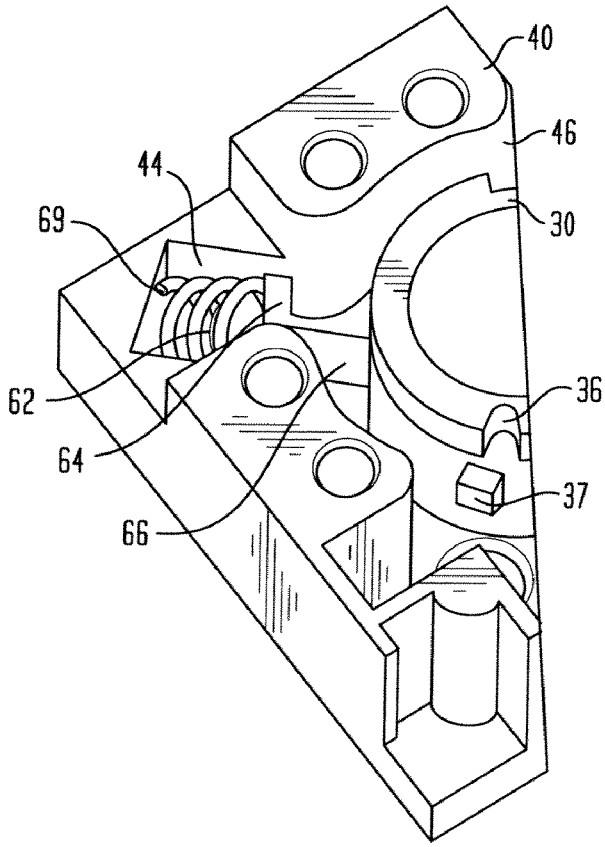
FIG. 9 is an enlarged sectional perspective view of an exemplary actuator along with a pusher and a spring as assembled inside a push-pull body according to the embodiment illustrated in FIG. 1.

FIG. 9 is an enlarged sectional perspective view of an exemplary actuator 30, along with a pusher 60, and a spring 69, as assembled inside a push-pull body 40, according to the embodiment illustrated in FIG. 1.

Figure 10:
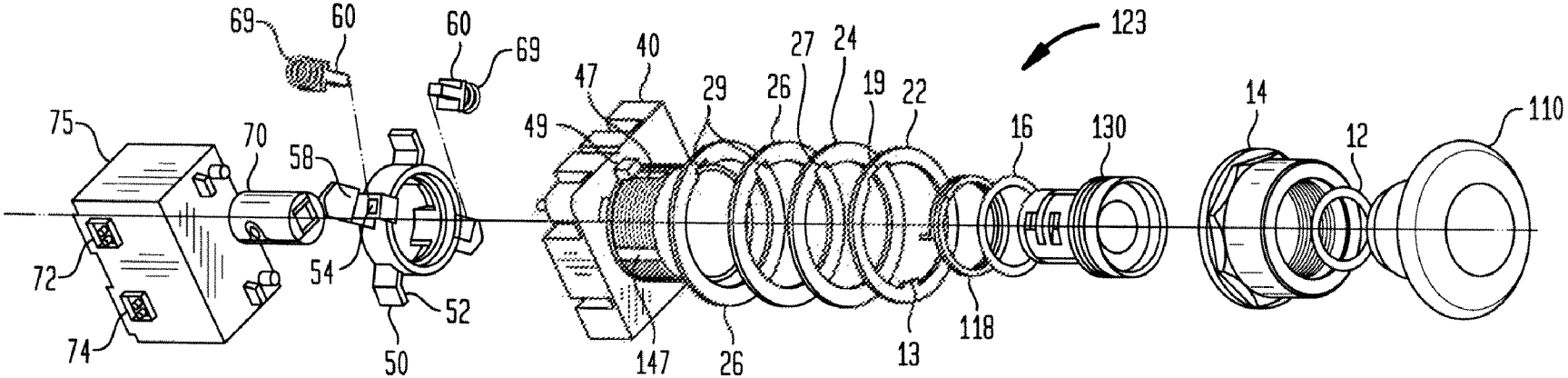
FIG. 10 is an exploded view of an exemplary pushbutton switch having a two position maintained switch with an integral LED and Actuator which is used to illustrate a second embodiment of the present invention.

FIG. 10 is an exploded view of an exemplary pushbutton switch 123, having a two position maintained switch with an integral LED and Actuator which is used to illustrate a second embodiment of the present invention. The pushbutton switch 123, is similar to the pushbutton switch 23, except that the actuator 130, and the actuator spring 118, are different then ones illustrated in FIG. 1. Knob or button 110, is preferably a mushroom head type button 110. The button 110, is preferably a push-pull type of a button. As one can see that the button 110, does not have any markings 11, such as, arrows 11, which would indicate twist-type or rotational motion, therefore, this type of a button 110, is more likely to be a pull-type or push-type or a push-pull-type button 110.

FIG. 11 is an enlarged perspective view of an exemplary actuator 130, along with a pusher 60, and a spring 69, according to the embodiment illustrated in FIG. 10. The actuator 130, having a central opening 185, has an cap end 180, and a substantially cylindrical portion 189.

FIG. 12 is an enlarged perspective detailed view of an exemplary actuator 130, according to the embodiment illustrated in FIG. 10.

As illustrated in FIG. 11 and FIG. 12 the substantially cylindrical portion 189, has a substantially inverted I-shaped channel 135, and a first channel 136, and a second channel 137, wherein at least a portion of the first channel 136, is connected to at least a portion of the second channel 137. The I-shaped channel 135, is defined by a back wall or stop 131, and a front wall or stop 139, and a first or back channel stop 132, a first or back ramp 133, a second or front ramp 138, and a second or front channel stop 134. The second channel 137, and a back stop 181, so as to force a component to move in forward, backward and side motion only.

As shown in FIG. 11 and FIG. 12, the contoured end 68, of the pusher 60, can move in a forward and backward direction only, as it can start at the first or back channel stop 132, moving up the back-ramp 133, over the front ramp 138, and into the second or front channel stop 134, or back into the first or back channel stop 32, as the I-shaped channel 136, only allows movement in a front and back direction or in a sideways direction, but the pusher 60, once in the I-shaped channel 135, would either stop at the back stop 132, or at the front stop 139, or the TAB 43 on the Body 40, will be stopped by the back stop 181, in the second channel 137.

Figure 13:
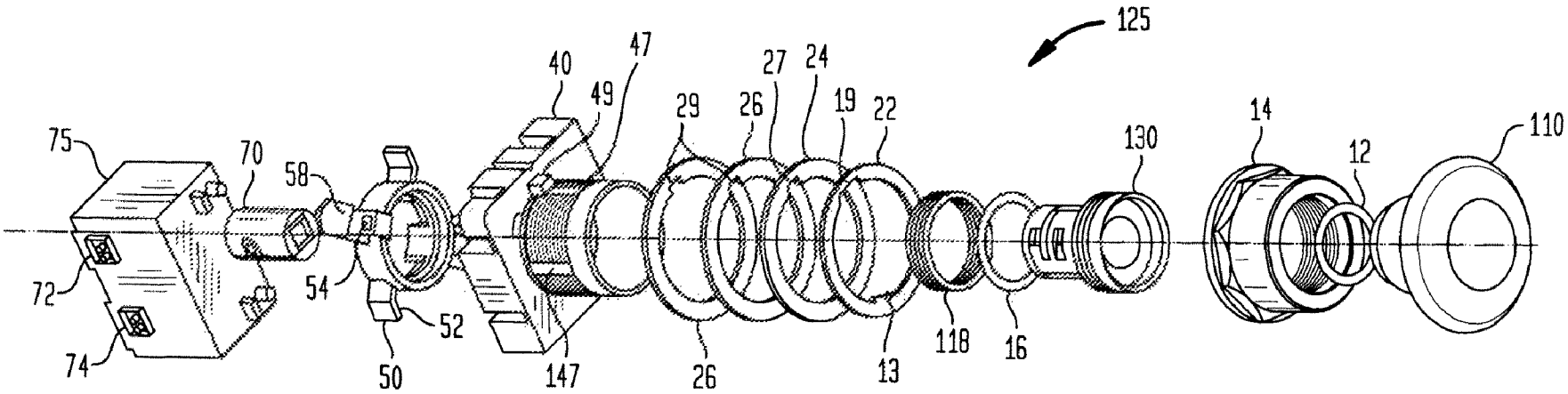
FIG. 13 is an exploded view of an exemplary pushbutton switch having a two position momentary switch with an integral LED and Actuator which is used to illustrate a third embodiment of the present invention.

FIG. 13 is an exploded view of an exemplary pushbutton switch 125, having a two position momentary switch with an integral LED and actuator 130, which is used to illustrate a third embodiment of the present invention. The pushbutton switch 125, is similar to the pushbutton switch 123, as illustrated in FIG. 10, except that the detent bearing 50, is inserted inside the push-pull body 40, without the pusher 60, or the spring 69, this allows the pushbutton switch 125, to be engaged momentarily while force is being exerted on the button or knob 110, as the actuator spring 118, will bring the pushbutton switch 125, back to its original position of being either engaged or disengaged, depending on how the pushbutton switch 125, is being used.

Figure 14:
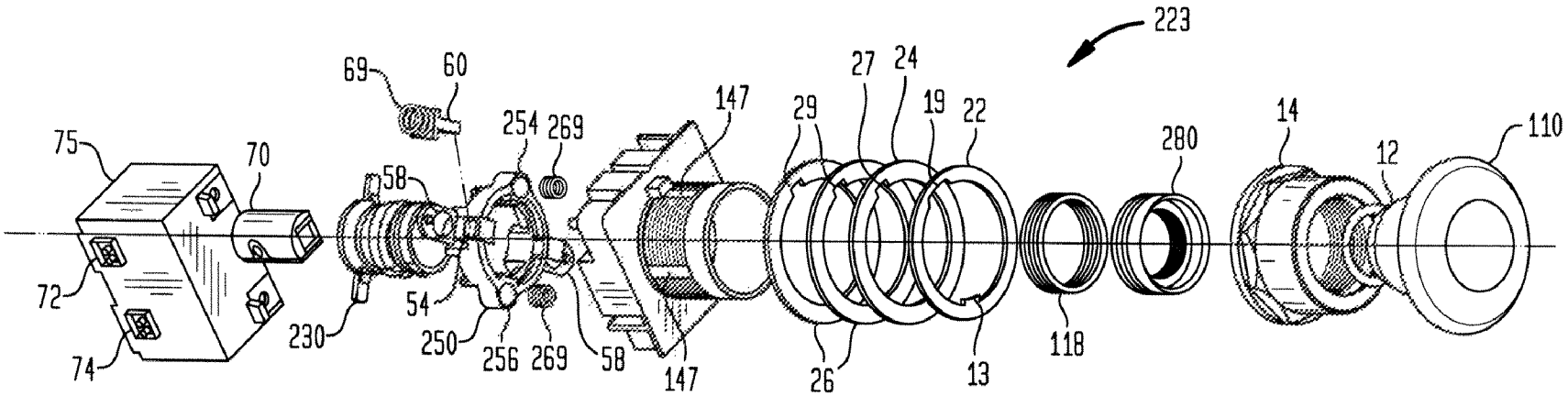
FIG. 14 is an exploded view of an exemplary pushbutton switch having a three position momentary switch with an integral LED and Actuator which is used to illustrate a fourth embodiment of the present invention.

FIG. 14 is an exploded view of an exemplary pushbutton switch 223, having a three position momentary switch with an integral LED and actuator 230, which is used to illustrate a fourth embodiment of the present invention. In this fourth embodiment the knob I 10, when pushed or pressed would engage the assembly 223, for a moment and once the force of pushing or pressing is removed the assembly 223, would revert to its previous state. A more detailed view of the inventive actuator 230, can be seen in FIG. 35, and the discussion appears in the text related to FIG. 35. For the ease of understanding the second pusher 60, with pusher spring 69, that goes into hole 54, in the detent bearing 250, is not shown.

Figure 15:
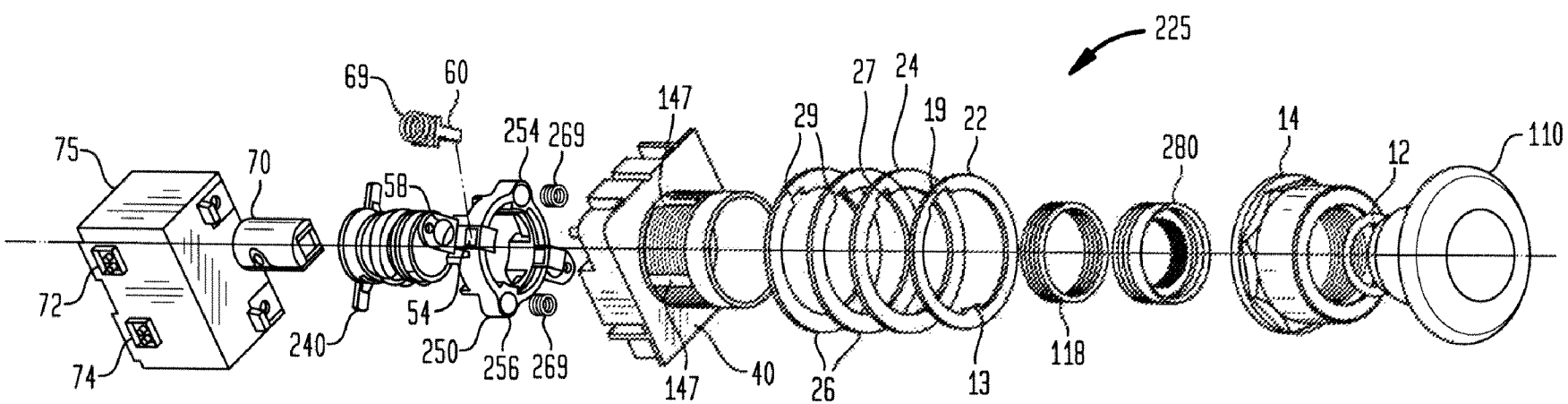
FIG. 15 is an exploded view of an exemplary pushbutton switch having a three position maintained switch with an integral LED and Actuator which is used to illustrate a fifth embodiment of the present invention.

FIG. 15 is an exploded view of an exemplary pushbutton switch 225, having a three position maintained switch with an integral LED and actuator 240, which is used to illustrate a fifth embodiment of the present invention. In this fifth embodiment the knob 110, when pushed or pressed would engage the assembly 225, for a moment and once the force of pushing or pressing is removed the assembly 225, would maintain it current position and not revert to its previous state. A more detailed view of the inventive actuator 240, can be seen in FIG. 16, FIG. 17, and FIG. 34, and the discussion appears in the text the corresponds to FIGS. 16, 17, and 34. For the ease of understanding the second pusher 60, with pusher spring 69, that goes into hole 54, in the detent bearing 250, is not shown.

Figure 16:
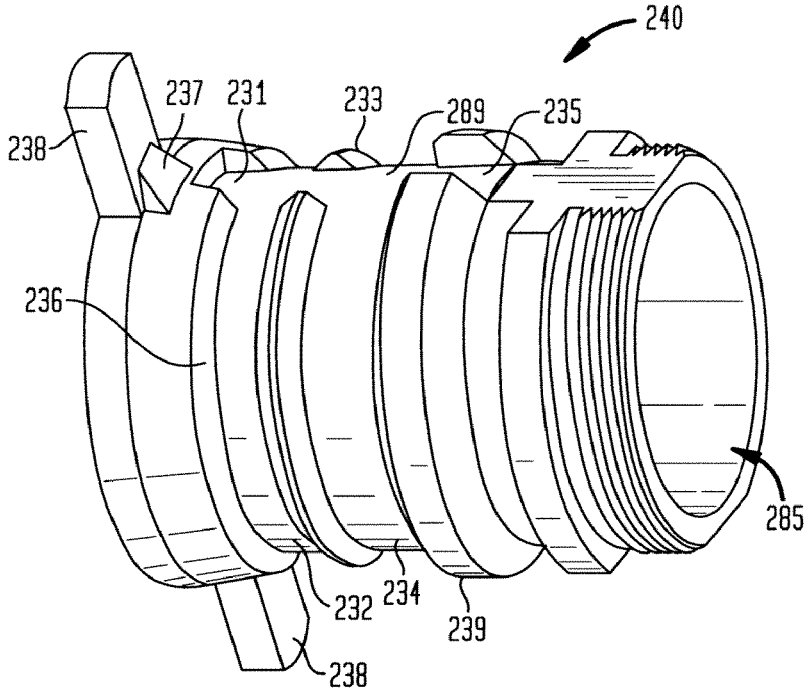
FIG. 16 is an enlarged perspective view of an exemplary actuator according to the embodiments illustrated in FIG. 15.

FIG. 16 is an enlarged perspective view of an exemplary actuator 240, according to the embodiments illustrated in FIG. 15. The actuator 240, has a central hole or opening 285, a substantially cylindrical portion 289, having a channel 235, that terminates at a notch 231, proximate to a brace 238. The brace 238, could have a side brace 237. The channel 235, allows the pusher 60, to move forward, backward and sideways in the channel 235.

Figure 17:
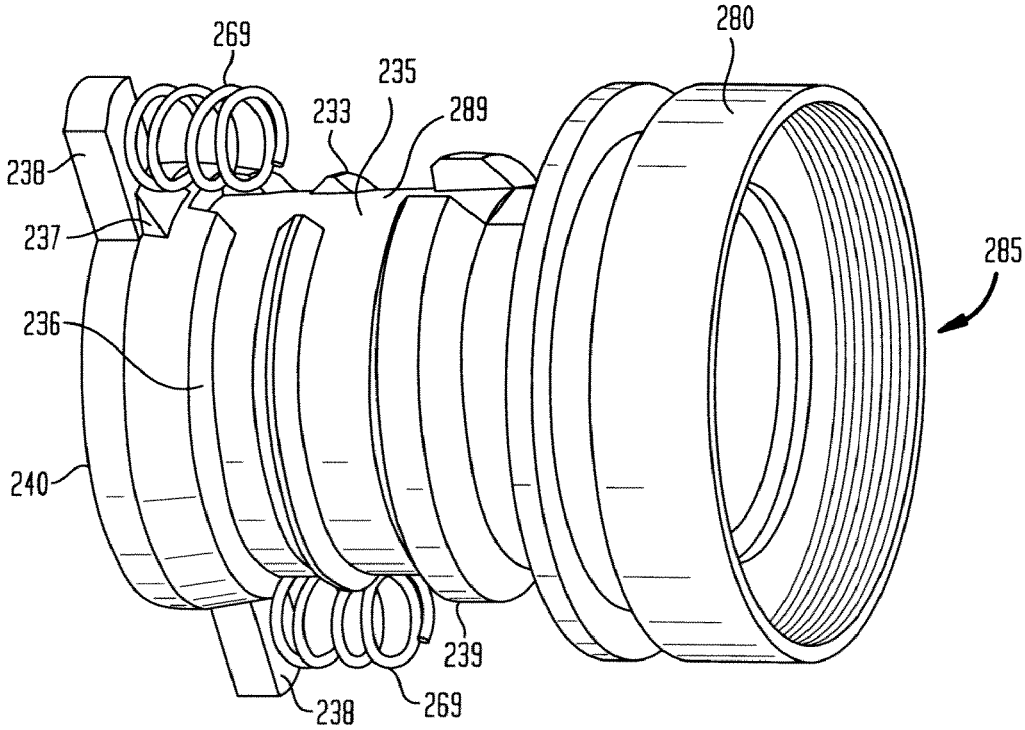
FIG. 17 is an enlarged perspective view of an exemplary actuator along with a spring and actuator cap according to the embodiments illustrated in FIG. 15.

FIG. 17 is an enlarged perspective view of an exemplary actuator 240, along with a side spring 269, and a actuator cap 280, according to the embodiments illustrated in FIG. 15 and FIG. 16.

Figure 18:
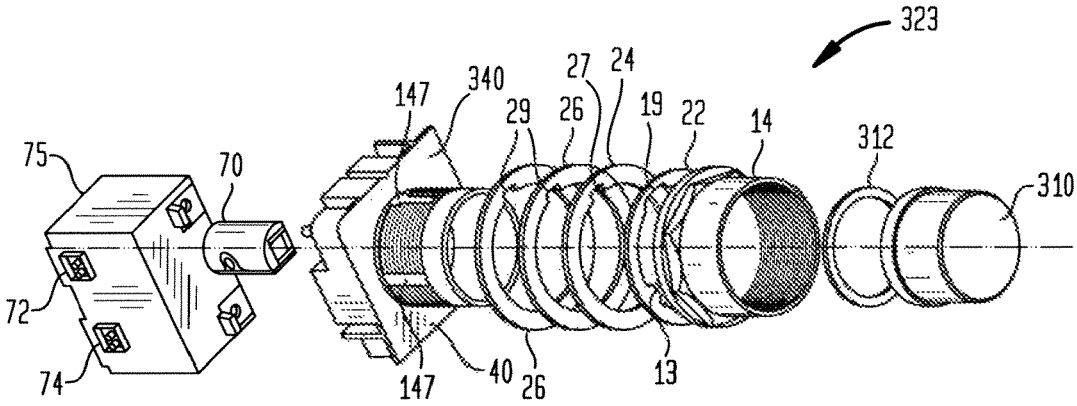
FIG. 18 is an exploded view of an exemplary pushbutton switch having a light with an integral LED which is used to illustrate a sixth embodiment of the present invention.

FIG. 18 is an exploded view of an exemplary pushbutton switch 323, having a light with an integral LED and actuator which is used to illustrate a sixth embodiment of the present invention. The components for the Pilot Light 323, are similar to the ones illustrated earlier except that the button or knob 310, and the push-pull body 340, are different. The push-pull body 340, does not have a anti-rotational notch or tab 49, however, that feature can now be done using a tab washer 22, as more clearly seen with reference to FIG. 19 and FIG. 20. Locknut 14, is threaded on to the threads of push pull body 340. Knob 310, which is also called a lens 310, is threaded into the locknut 14, from the right side or end. Once installed, unlike the previous switches, there is no relative movement between the lens 310, and the locknut 14.

Figure 19:
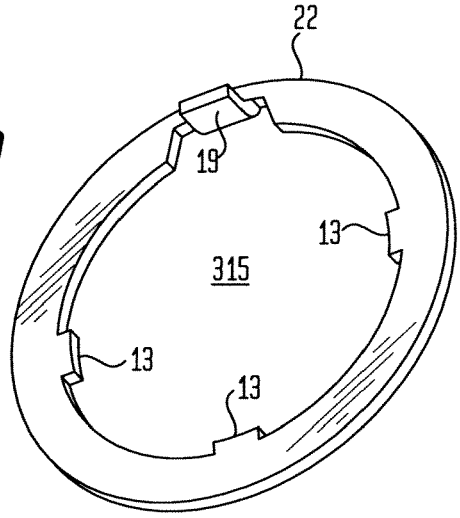
FIG. 19 is an enlarged perspective view of an exemplary tab washer from a front side according to the embodiment illustrated in FIG. 18.
Figure 20:
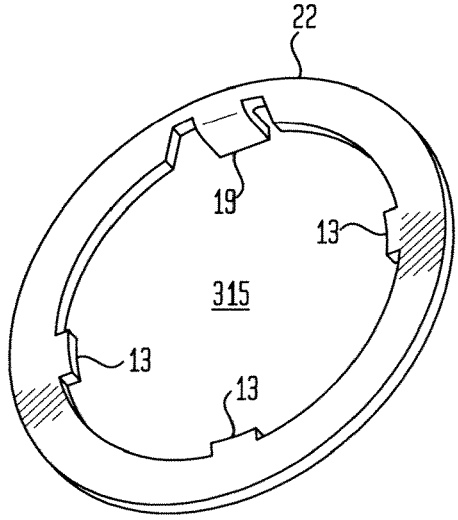
FIG. 20 is an enlarged perspective view of an exemplary tab washer from a back side according to the embodiment illustrated in FIG. 18.

FIG. 19 is an enlarged perspective view of an exemplary tab washer 22, from a front side according to the embodiment illustrated in FIG. 1 and FIG. 18. The tab washer 22, has a central opening 315, having at least one tab or notch 13. The tab washer 22, preferably has at least one tab 19, that is preferably bent out of the inner peripheral material of the tab washer 22, as shown in FIGS. 19 and 20. The base of the tab 19, guides along the flat surface 147, and passes through notches 27 and 29, in the washer 24, and gasket 26, respectively. Because the tab 19, sits on the flat surface 147, it acts as an anti-rotational device and prevents the rotation of the components, such as, for example washer 22, washer 24, and the gasket 26.

FIG. 20 is an enlarged perspective view of an exemplary tab washer 22, from a back side according to the embodiment illustrated in FIG. 18.

Figure 21:
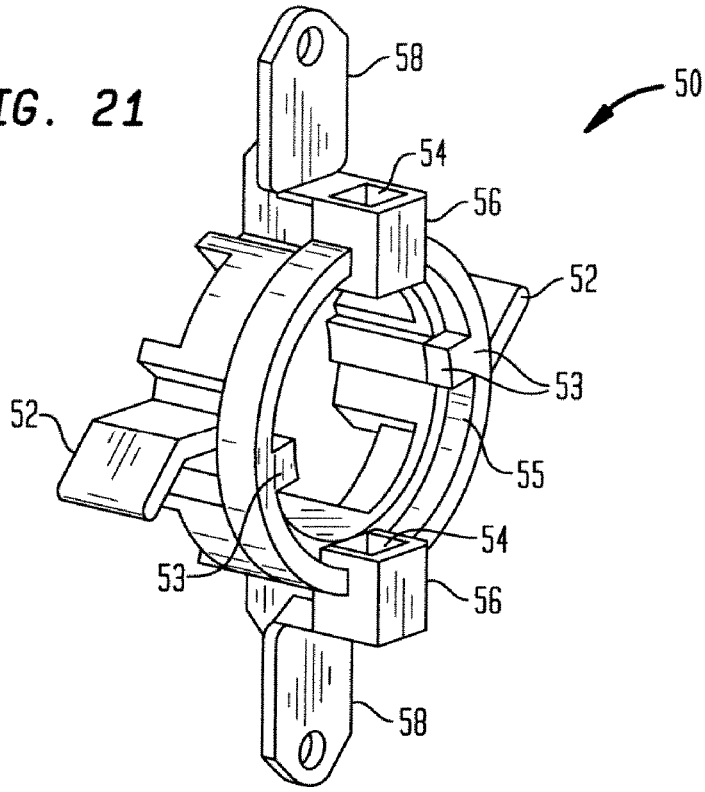
FIG. 21 is an enlarged perspective view of an exemplary detent bearing from a front side according to the embodiment illustrated in FIGS. 10 & 13.

FIG. 21 is an enlarged perspective view of an exemplary detent bearing 50, from a front side according to the embodiment illustrated in FIG. 1.

Figure 22:
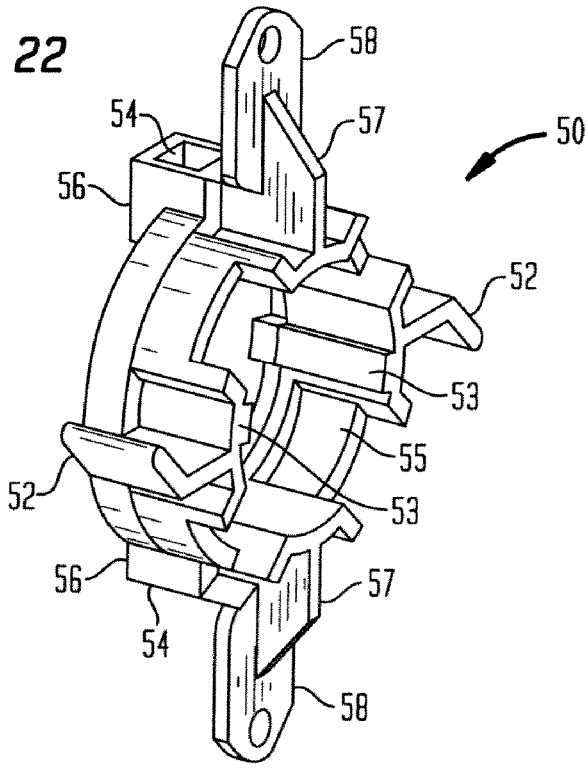
FIG. 22 is an enlarged perspective view of an exemplary detent bearing from a back side according to the embodiment illustrated in FIGS. 10 & 13.

FIG. 22 is an enlarged perspective view of an exemplary detent bearing 50, from a back side according to the embodiment illustrated in FIG. 1.

Figure 23:
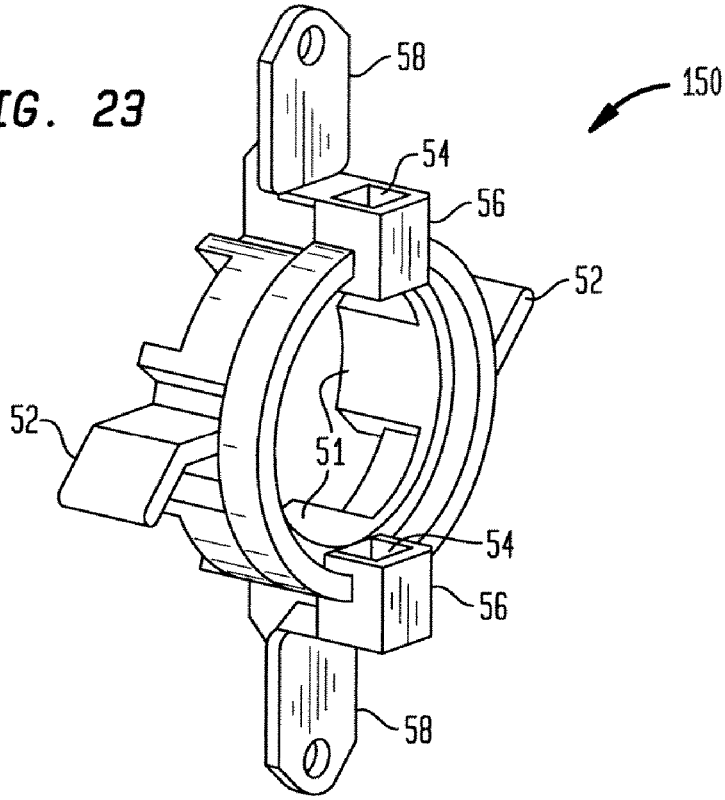
FIG. 23 is an enlarged perspective view of an exemplary detent bearing from a front side according to the embodiment illustrated in FIG. 1.

FIG. 23 is an enlarged perspective view of an exemplary detent bearing 150, from a front side according to the embodiment illustrated in FIG. 13.

Figure 24:
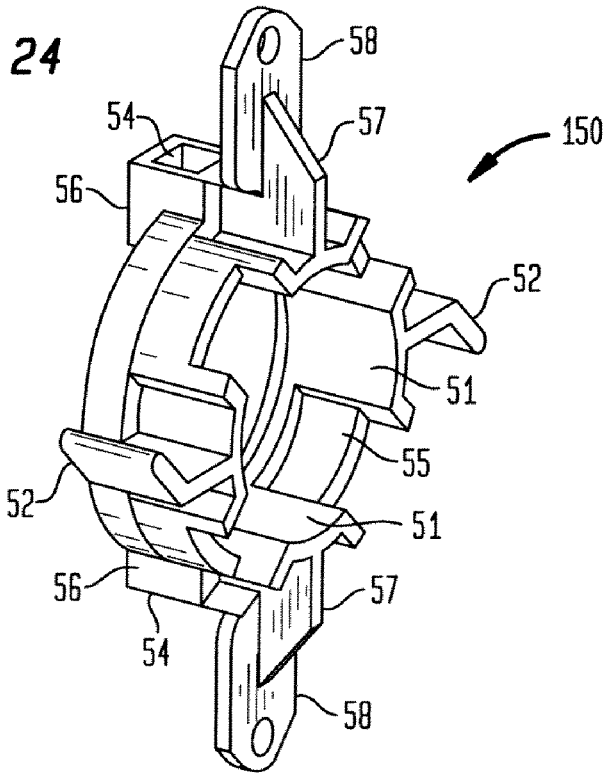
FIG. 24 is an enlarged perspective view of an exemplary detent bearing from a back side according to the embodiment illustrated in FIG. 1.

FIG. 24 is an enlarged perspective view of an exemplary detent bearing 150, from a back side according to the embodiment illustrated in FIG. 13.

Figure 25:
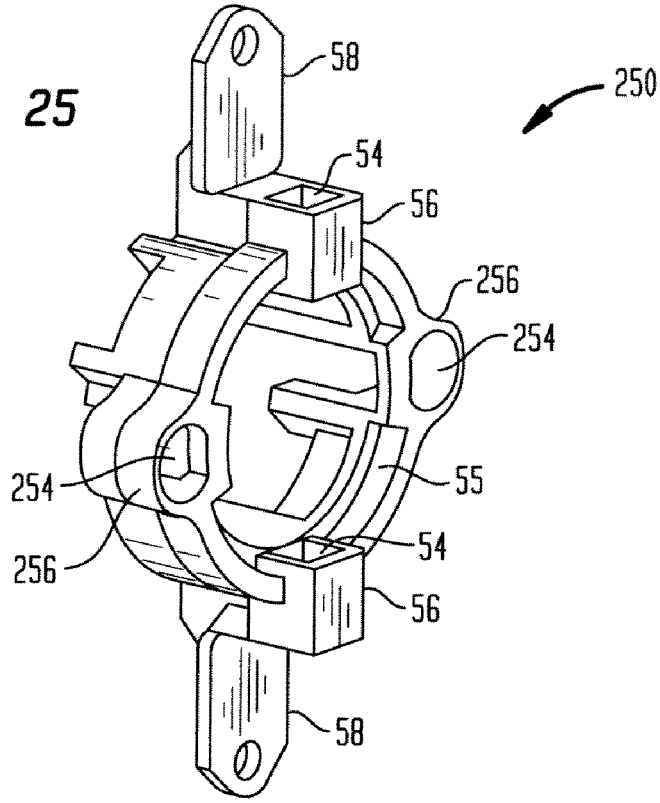
FIG. 25 is an enlarged perspective view of an exemplary detent bearing from a front side according to the embodiment illustrated in FIG. 14 and FIG. 15.

FIG. 25 is an enlarged perspective view of an exemplary detent bearing 250, from a front side according to the embodiment illustrated in FIG. 14 and FIG. 15.

Figure 26:
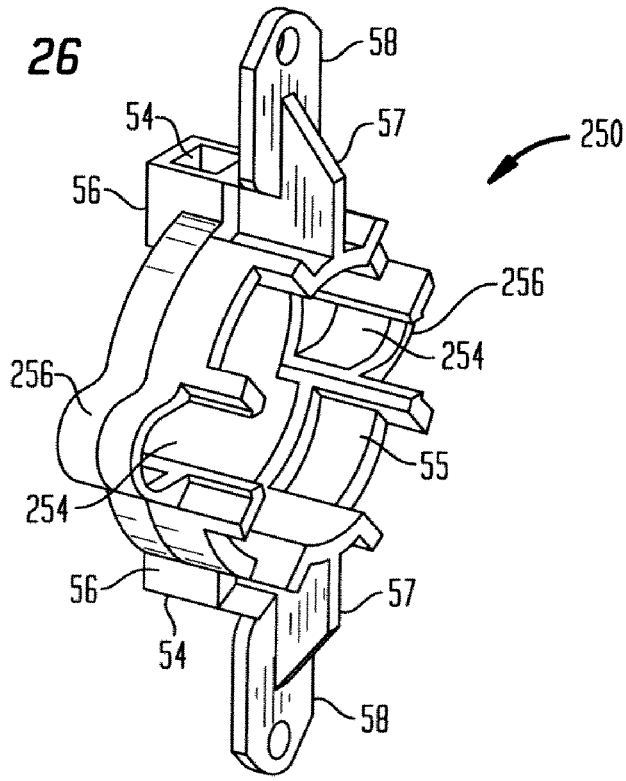
FIG. 26 is an enlarged perspective view of an exemplary detent bearing from a back side according to the embodiment illustrated in FIG. 14 and FIG. 15.

FIG. 26 is an enlarged perspective view of an exemplary detent bearing 250, from a back side according to the embodiment illustrated in FIG. 14 and FIG. 15.

FIG. 27 is an enlarged side perspective view of an exemplary actuator 30, according to the embodiment illustrated in FIG. 1. The actuator 30, preferably has at least one hole or opening 121, to accommodate one end of the spring 13, and to prevent the spring 13, from rotating.

FIG. 28 is an enlarged perspective view of an exemplary spring 13, according to the embodiment illustrated in FIG. 1. It is preferred that a first end 113, of the spring 13, is bent inwardly, and is at an angle to the radial plane of the spring 13, while the second end 115, is bent upwardly, and is almost perpendicular to the radial plane of the spring 13.

FIG. 29 is an enlarged side perspective view of an exemplary actuator 30, and the spring 13, according to the embodiment illustrated in FIG. 1, such that the first end 113, is inside the hole or opening 121, and thus the spring 13, is prevented from rotating. The spring 13, will of course have lateral movement but no appreciable rotational movement.

Figure 30:
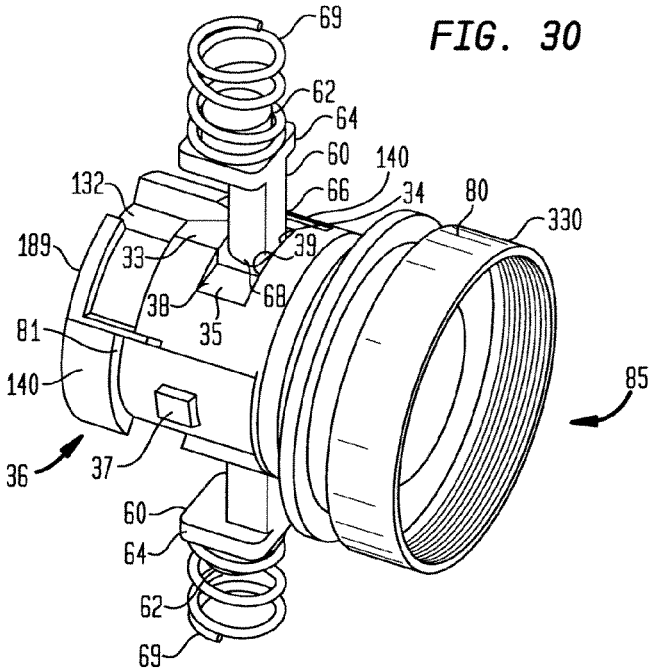
FIG. 30 is an enlarged perspective view of an exemplary actuator along with a pusher and a spring according to the embodiment illustrated in FIG. 1.

FIG. 30 is an enlarged perspective view of an exemplary actuator 330, along with a pusher 60, and a spring 69, according to the embodiment illustrated in FIG. 1, where the actuator 330, is similar to the actuator 30, but the layout is a little bit different, for example, the actuator 330, does not have a back stop 31, but rather a ramp 132, for the passage of the pusher 60, and then a back stop 189, to prevent the pusher 60, from sliding back out of the actuator 330. The actuator 330, also has a wall area 140, having a backstop 81, which is similar to the back stop 81, discussed with reference to FIG. 2. The actuator 330, can be used in the embodiment illustrated in FIG. 1, as a replacement for actuator 30.

Figure 31:
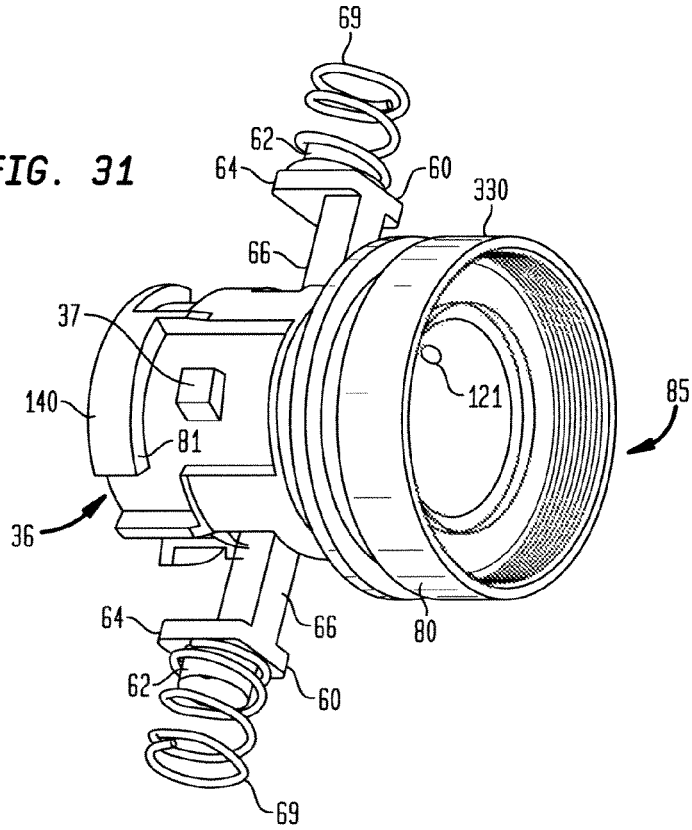
FIG. 31 is an enlarged perspective view of an exemplary actuator along with a pusher and a spring according to the embodiment illustrated in FIG. 1.

FIG. 31 is an enlarged perspective view of an exemplary actuator 330, along with a pusher 60, and a spring 69, according to the embodiment illustrated in FIG. 1 and FIG. 30. The channel 36, is a Q-shaped channel 36, with a center island 37, a back stop 81, and a wall area 140.

Figure 32:
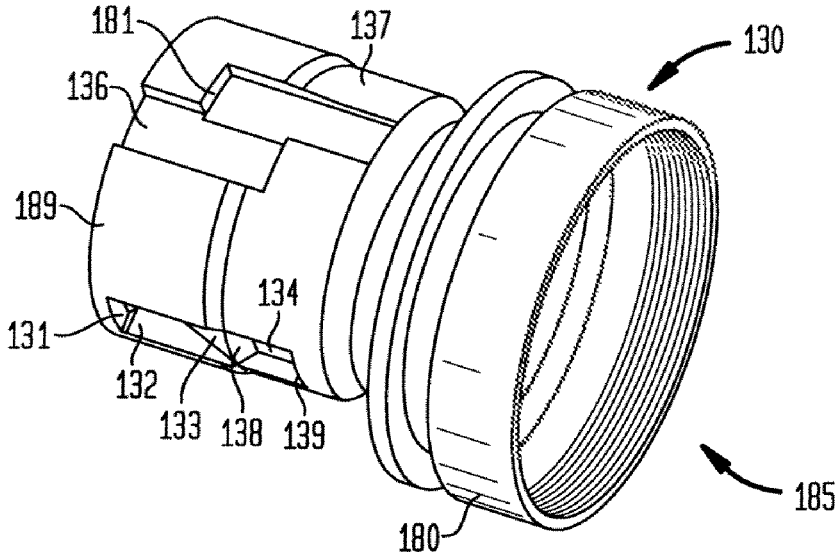
FIG. 32 is an enlarged perspective detailed view of an exemplary actuator according to the embodiment illustrated in FIG. 10 and FIG. 13.

FIG. 32 is an enlarged perspective detailed view of an exemplary actuator 130, according to the embodiment illustrated in FIG. 10 and FIG. 13.

Figure 33:
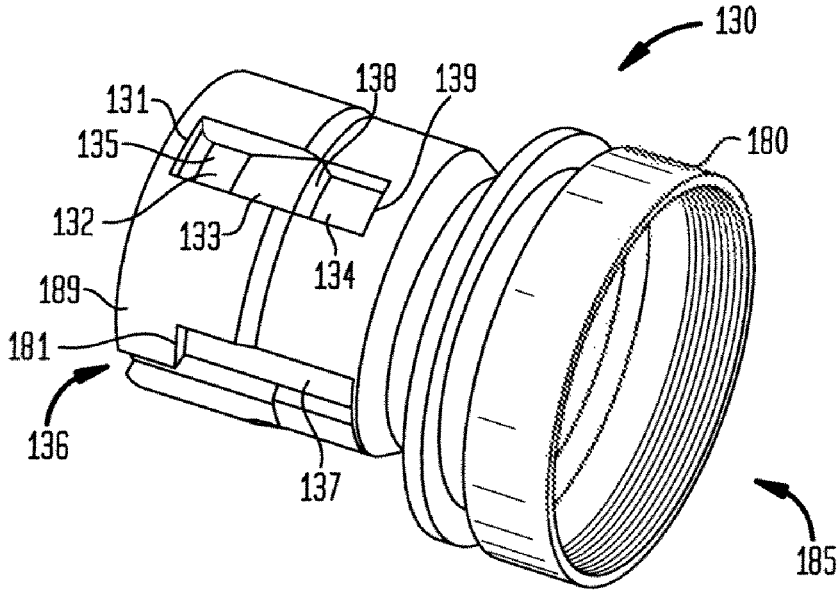
FIG. 33 is an enlarged perspective detailed view of an exemplary actuator according to the embodiment illustrated in FIG. 10 and FIG. 13.

FIG. 33 is an enlarged perspective detailed view of an exemplary actuator 130, according to the embodiment illustrated in FIG. 10 and FIG. 13.

Figure 34:
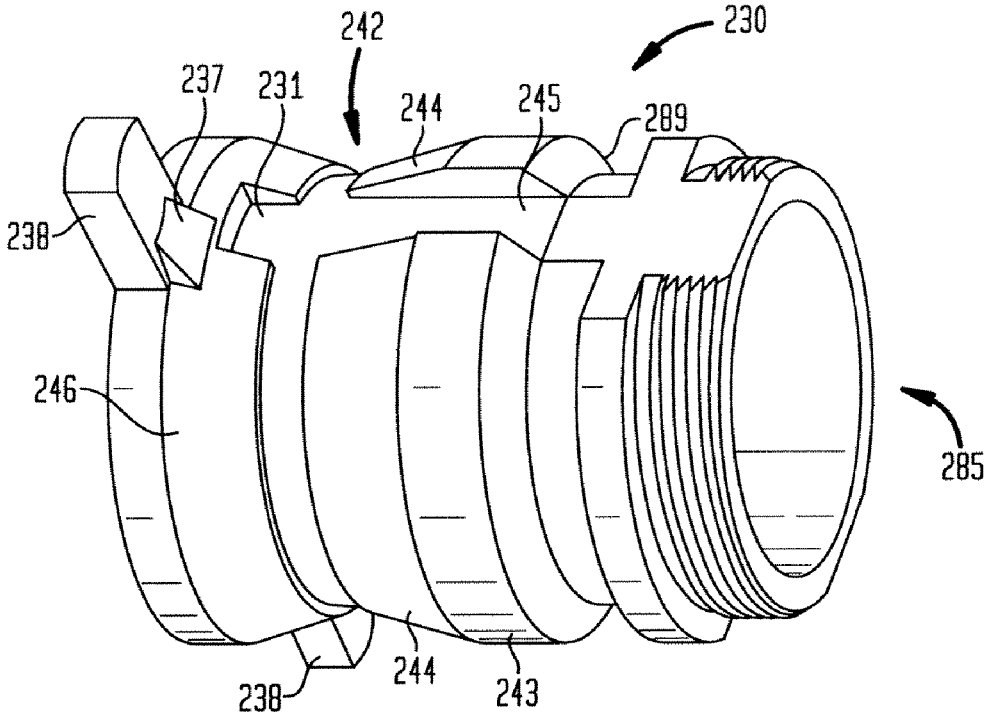
FIG. 34 is an enlarged perspective detailed view of an exemplary actuator according to the embodiment illustrated in FIG. 15.

FIG. 34 is an enlarged perspective detailed view of an exemplary actuator 230, according to the embodiment illustrated in FIG. 14. As stated earlier that the actuator 230, has a central hole or opening 285, and a substantially cylindrical portion 289, having a channel 245, that terminates at a notch 231, proximate to a brace 238. The brace 238, could have a side brace 237. The channel 245, allows the pusher 60, to move forward, backward and sideways in the channel 245. The actuator 230, has an area 242, which is defined by a first sloping wall 246, and a second sloping wall 244. The actuator 230, could have a substantially radially flat area 243, adjacent the second sloping wall 244. Basically, the outer cylindrical surface of the actuator 230, forms three zones, the first zone is formed by the surface 244, which allows the pusher 60, to ride up momentarily while there is force on the knob 10, 10, 310, 350, the second zone is formed by the surface 242, which is also the default zone 242, as the pusher 60, resides there and is held there, especially, due to the force of the pusher springs 69, and the third zone is formed by the positive sloping wall 246, which allows the pusher 60, to ride up momentarily while there is force on the knob 10, 110, 310, 350. However, as one can appreciate that the channel 245, allows an unimpeded movement of the pusher 60, from zone to zone. The channel 245, also allows the sideways movement of the pusher 60, into zone two 242.

Figure 35:
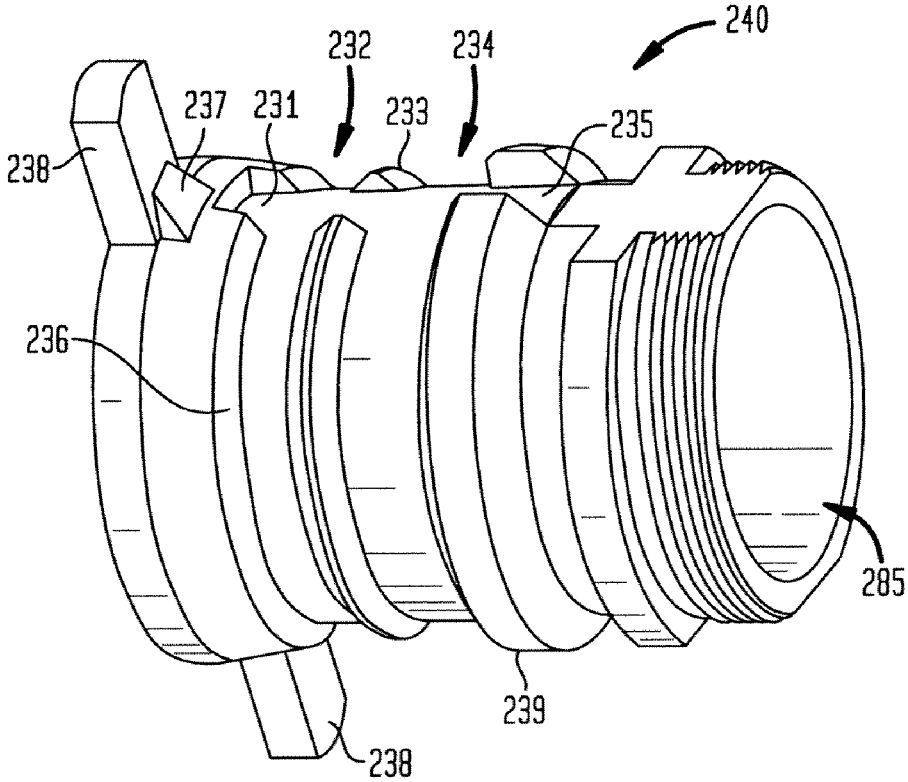
FIG. 35 is an enlarged perspective detailed view of an exemplary actuator according to the embodiment illustrated in FIG. 14.

FIG. 35 is an enlarged perspective detailed view of an exemplary actuator 240, according to the embodiment illustrated in FIG. 14. As stated earlier that the actuator 240, has a central hole or opening 285, and a substantially cylindrical portion 289, having a channel 235, that terminates at a notch 231, proximate to a brace 238. The brace 238, could have a side brace 237. The channel 235, allows the pusher 60, to move forward, backward and sideways in the channel 235. The actuator 240, has a sloping wall 233, such that it forms a first area or valley 232, and a second area or valley 234, such that the first area 232, is defined with the sloping wall 233, and a wall 236, and that the second area 234, is defined by the sloping wall 233, and a wall 239. Basically, the outer cylindrical surface of the actuator 240, forms three zones, the first zone is formed by the surface 234, which allows the pusher 60, to stay in place when the force from the knob 10, 110, 310, 350, moves it into the first zone, the second zone is formed by the surface 232, which is also the default zone 232, as the pusher 60, resides there and is held there, especially, due to the force of the pusher springs 69, and the third zone is formed by the positive sloping wall 236, which allows the pusher 60, to ride up momentarily while there is force on the knob 10, 110, 310, 350. The first zone 234, is separated from the second zone 232, by the sloping wall 233, which forces the pusher head to either move and stay inside zone one or move and stay inside zone two. However, as one can appreciate that the channel 235, allows an unimpeded movement of the pusher 60, from zone to zone. The channel 235, also allows the sideways movement of the pusher 60, into either zone one 234, or zone two 232.

Figure 36:
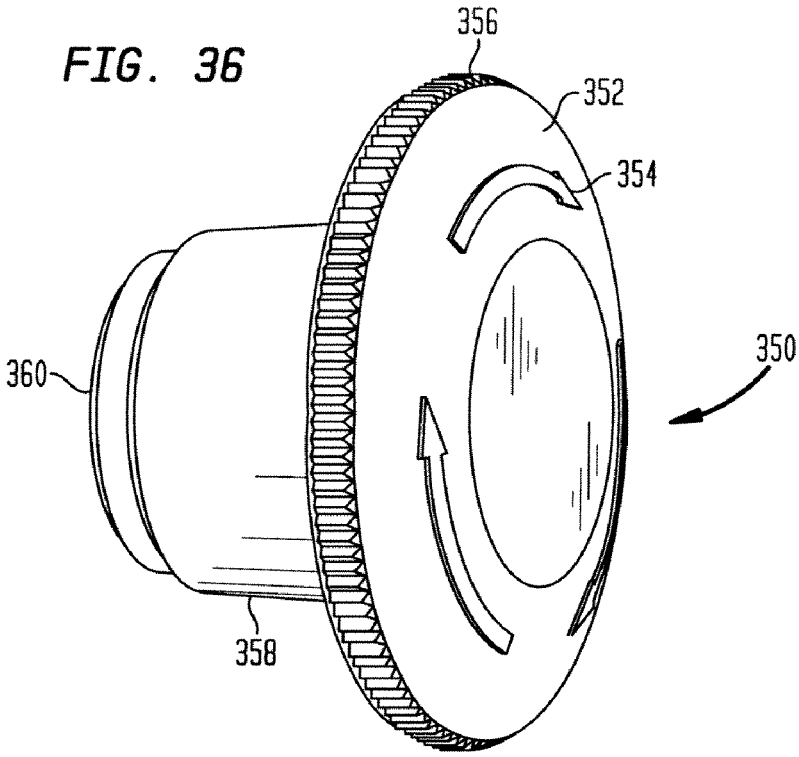
FIG. 36 is an enlarged perspective detailed view of an exemplary inventive button to be used with the embodiments of this invention.

FIG. 36 is an enlarged perspective detailed view of an exemplary inventive button 350, to be used with the embodiments of this invention. The button 350, preferably has a mushroom type shape 352, and preferably on the outer surface could have markings 354. The button 350, could also be provided with knurls or ridges 356, which would preferably run along the outer peripheral surface of the button 350, and would make it easier to grip the button 350, especially during operations. The button could also have a body 358, having a hollow interior or a blind hole 360.

Figure 37:
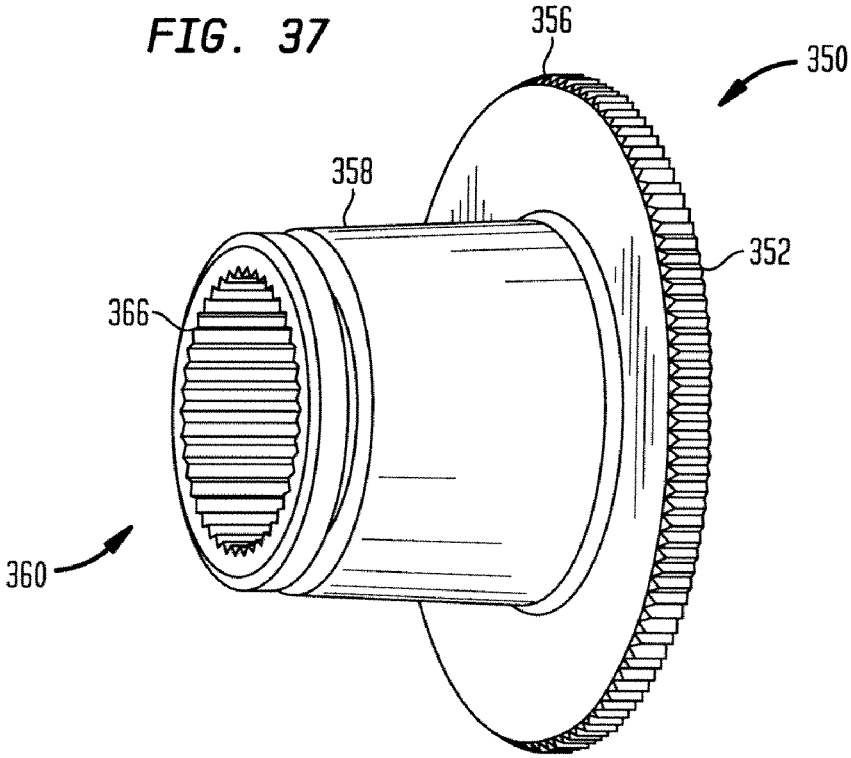
FIG. 37 is an enlarged detailed rear view of an exemplary inventive button to be used with this invention according to the embodiment illustrated in FIG. 36.

FIG. 37 is an enlarged detailed rear view of an exemplary inventive button 350, to be used with this invention according to the embodiment illustrated in FIG. 36. As one can clearly see that on the inside surface of the hollow interior or blind hole 360, the body 358, could be provided with interior knurls or ridges or splines 366. The interior knurls or ridges or splines 366, would help in scattering the light received from an LED in the LED module 75, especially, when the button 350, is made from a material that is transparent or translucent.

The button 350, could also be used in embodiments that require a push-pull type button 350, however, for those situations one would most probably not need the knurls or ridges 356, or the markings 354, that indicate a twist-type or rotational motion.

The actuator 30, is preferably made of an electrically insulating material, wherein the electrically insulating material is selected from a group comprising, Teflon, nylon, plastic, composite material, and combination thereof, to name a few.

The tab or notch 49, in the push-pull body 40, to accommodate the washers 22, 24, and gaskets 26, is preferably has a shape which is selected from a group comprising, a trapezoidal shape, a square shape, a rectangular shape, an elliptical shape, a triangular shape, and combination thereof, to name a few.

The locknut 14, is preferably made from material selected from a group comprising, stainless steel, steel, metallic material, plastic, rubber, composite, and combination thereof, to name a few.

The washer 22 or washer 24, is preferably made from material selected from a group comprising, stainless steel, steel, metallic material, plastic, rubber, composite, and combination thereof, to name a few.

The gasket 12 or gasket 26, is preferably made from material selected from a group comprising, stainless steel, steel, metallic material, plastic, rubber, composite, and combination thereof, to name a few.

The detent bearing 50, is preferably made from material selected from a group comprising, stainless steel, steel, metallic material, plastic, rubber, composite, and combination thereof, to name a few.

The push-pull body 40, is preferably made from material selected from a group comprising, stainless steel, steel, metallic material, plastic, rubber, composite, and combination thereof, to name a few.

The actuator 30, is preferably made from material selected from a group comprising, stainless steel, steel, metallic material, plastic, rubber, composite, and combination thereof, to name a few.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A pushbutton actuator, comprising:

(a) a push-pull body, wherein said push-pull body has a first portion and a second portion, wherein said first portion comprises of a substantially hollow cylindrical body, and said second portion comprises a substantially flat portion;

(b) at least one anti-rotational tab, wherein a portion of said tab is secured to said first portion and wherein a portion of said tab is secured to said second portion;

(c) a detent bearing, wherein said flat portion having an area to accommodate said detent bearing;

(d) a knob, wherein said first portion having an area to accommodate said knob;

(e) an actuator, wherein at least a portion of said actuator is enveloped within a hollow portion of said push-pull body, (f) a module, wherein a portion of said module passes through said detent bearing, said first and said second portion of said push-pull body, and is in proximate contact with said actuator, and thereby forming said pushbutton actuator.

2. The pushbutton actuator of claim 1, wherein said first portion of said push-pull body comprises at least one longitudinally flat portion along said substantially cylindrical body.

3. The pushbutton actuator of claim 1, wherein said actuator has a substantially cylindrical portion having at least one ramp channel to accommodate a surface movement of at least one pusher.

4. The pushbutton actuator of claim 1, wherein said push-pull body has at least one orientation tab along a portion of an inside wall.

5. The pushbutton actuator of claim 1, wherein said push-pull body has at least one hole to accommodate one end of a spring.

6. The pushbutton actuator of claim 1, wherein said actuator has a substantially cylindrical portion having at least one longitudinal ramp channel and at least one radial ramp channel, and wherein said longitudinal ramp channel allows translational surface movement for at least one pusher, and said radial ramp channel accommodates a rotational surface movement of said at least one pusher.

7. The pushbutton actuator of claim 1, wherein said actuator has a substantially cylindrical portion, and wherein said cylindrical portion has at least one back stop along at least a peripheral edge portion of said actuator.

8. The pushbutton actuator of claim 1, wherein said detent bearing has at least one extension for orienting said detent bearing.

9. The pushbutton actuator of claim 1, wherein said detent bearing has at least one extension for orienting said detent bearing into a secure contact with said push-pull body.

10. The pushbutton actuator of claim 1, wherein said detent bearing has at least one opening to accommodate a vertical movement of a pusher having a pusher spring.

11. The pushbutton actuator of claim 1, wherein said second portion of said push-pull body has at least one opening to accommodate at least one pusher and a pusher spring.

12. The pushbutton actuator of claim 1, wherein at least one washer having at least one bent tab is mated with said push-pull body such that at least a portion of bent tab is in physical contact with said anti-rotational tab.

13. The pushbutton actuator of claim 1, wherein said module has at least one LED, and upon assembly of said module said LED is adjacent said knob.

14. The pushbutton actuator of claim 1, wherein actuator has an opening and said at least one spring has a bent end and wherein said opening securely accommodates said bent end of said spring.

15. The pushbutton actuator of claim 14 wherein at least one spring is slidingly secured onto said actuator.

16. The pushbutton actuator of claim 1, wherein said actuator has at least one channel to accommodate a corresponding tracking component.

17. The pushbutton actuator of claim 1, wherein said actuator has at least one channel to accommodate a corresponding tracking component, and wherein said channel is selected from a group consisting of a P-shaped channel and a Q-shaped channel.

18. The pushbutton actuator of claim 1, wherein said module has at least one LED.

19. A pushbutton actuator, comprising:

(a) a push-pull body, wherein said push-pull body has a first portion and a second portion, wherein said first portion comprises of a substantially hollow cylindrical body, and said second portion comprises a substantially flat portion;

(b) at least one anti-rotational tab, wherein a portion of said tab is secured to said first portion and wherein a portion of said tab is secured to said second portion;

(c) a detent bearing, wherein said detent bearing has at least one vertically oriented opening to accommodate a vertical movement of a pusher, and at least one longitudinally oriented opening to accommodate a longitudinally oriented spring, and wherein said push-pull body has an area to accommodate said detent bearing;

(d) a knob, wherein said first portion having an area to accommodate said knob;

(e) an actuator, wherein at least a portion of said actuator is enveloped within a hollow portion of said push-pull body, (f) a module, wherein a portion of said module passes through said detent bearing, said first and said second portion of said push-pull body, and is in proximate contact with said actuator, and thereby forming said pushbutton actuator.

20. A pushbutton actuator, comprising:

(a) a push-pull body, wherein said push-pull body has a first portion and a second portion, wherein said first portion comprises of a substantially hollow cylindrical body, and said second portion comprises a substantially flat portion;

(b) at least one anti-rotational tab, wherein a portion of said tab is secured to said first portion and wherein a portion of said tab is secured to said second portion;

(c) a detent bearing, wherein said flat portion having an area to accommodate said detent bearing;

(d) a knob, wherein said first portion having an area to accommodate said knob;

(e) an actuator, wherein at least a portion of said actuator is enveloped within a hollow portion of said push-pull body, (f) a module, wherein a portion of said module passes through said actuator, said detent bearing, said first and said second portion of said push-pull body, and is in proximate contact with said knob, and wherein said detent bearing is in proximate contact with said module, and thereby forms said pushbutton actuator.

21. The pushbutton actuator of claim 20, wherein said actuator has a substantially cylindrical body, and wherein said cylindrical body has at least one circular ring, such that said circular ring has a first area having a positive slope and a second area having a negative slope.

22. The pushbutton actuator of claim 20, wherein said actuator has a substantially cylindrical body, and wherein said cylindrical body has at least one circular ring, such that said circular ring has a first area having a positive slope and a second area having a negative slope, and at least one longitudinally oriented channel along the outer peripheral surface of said actuator.

23. The pushbutton actuator of claim 20, wherein said module includes an LED and said knob comprises a blind hole having an inside wall surface and wherein at least a portion of said inside wall surface has a plurality of longitudinally oriented splines wherein light emitted by the LED is scattered by said splines.

24. The pushbutton actuator of claim 23, wherein material for said knob is selected from a group consisting of transparent material, translucent material, and combinations thereof.

25. A multi-position pushbutton with an integral LED and an actuator, comprising:

(a) a push-pull body, wherein said push-pull body has a first portion and a second portion, wherein said first portion comprises of a substantially hollow cylindrical body, and said second portion comprises a substantially flat portion;

(b) at least one anti-rotational tab, wherein a portion of said tab is secured to said first portion and wherein a portion of said tab is secured to said second portion;

(c) a detent bearing, wherein said flat portion having an area to accommodate said detent bearing;

(d) a knob, wherein said first portion of said push-pull body having an area to accommodate said knob;

(e) an actuator, wherein at least a portion of said actuator is enveloped within a hollow portion of said push-pull body, (f) a module having at least one LED, wherein a portion of said LED passes through said detent bearing, said first and said second portion of said push-pull body, and is in proximate contact with said actuator, and thereby forming said multi-position pushbutton with an integral LED and an actuator.

26. A multi-position pushbutton with an integral LED and an actuator, comprising:

(a) a push-pull body, wherein said push-pull body has a first portion and a second portion, wherein said first portion comprises of a substantially hollow cylindrical body, and said second portion comprises a substantially flat portion;

(b) at least one anti-rotational tab, wherein a portion of said tab is secured to said first portion and wherein a portion of said tab is secured to said second portion;

(c) a detent bearing, wherein said detent bearing has at least one vertically oriented opening to accommodate a vertical movement of a pusher, and at least one longitudinally oriented opening to accommodate a longitudinally oriented spring, and wherein said push-pull body has an area to accommodate said detent bearing;

(d) a knob, wherein said first portion having an area to accommodate said knob;

(e) an actuator, wherein at least a portion of said actuator is enveloped within a hollow portion of said push-pull body, (f) a module having at least one LED, wherein a portion of said LED passes through said detent bearing, said first and said second portion of said push-pull body, and is in proximate contact with said actuator, and thereby forming said multi-position pushbutton with an integral LED and an actuator.

27. A multi-position pushbutton with an integral LED and an actuator, comprising:

(a) a push-pull body, wherein said push-pull body has a first portion and a second portion, wherein said first portion comprises of a substantially hollow cylindrical body, and said second portion comprises a substantially flat portion;

(b) at least one anti-rotational tab, wherein a portion of said tab is secured to said first portion and wherein a portion of said tab is secured to said second portion;

(c) a detent bearing, wherein said flat portion having an area to accommodate said detent bearing;

(d) a knob, wherein said first portion having an area to accommodate said knob; (e) an actuator, wherein at least a portion of said actuator is enveloped within a hollow portion of said push-pull body, (f) a module having at least one LED, wherein a portion of said LED passes through said actuator, said detent bearing, said first and said second portion of said push-pull body, and is in proximate contact with said knob, and wherein said detent bearing is in proximate contact with said module, and thereby forms said multi-position pushbutton with an integral LED and an actuator.

28. An actuator for a multi-position pushbutton with an integral LED, comprising, a substantially hollow cylindrical body, said cylindrical body having an outer surface, said outer surface having a second zone connected between a first zone and a third zone, wherein said first zone has a negative sloped wall and said third zone has substantially a positive sloped wall and wherein said outer surface includes a channel that extends through said first, second and third zones to enable movement of a pusher through said first, second and third zones.

29. The actuator for a multi-position pushbutton with an integral LED of claim 28, wherein said outer surface has at least one extension.

30. The actuator for a multi-position pushbutton with an integral LED of claim 28, wherein said outer surface has at least one extension to accommodate a back portion of a spring.

* * * * *